US005376257A

United States Patent [19]

Odan et al.

[11] Patent Number: 5,376,257

[45] Date of Patent: Dec. 27, 1994

[54] PROCESS FOR FEED OIL REFINING FOR PRODUCTION OF LUBRICATING OIL

[75] Inventors: Akinori Odan; Noboru Shimizu, both of Yokohama; Norihiko Ageishi, Yamato, all of Japan

[73] Assignee: Nippon Petroleum Refining Company, Limited, Tokyo, Japan

[21] Appl. No.: 100,173

[22] Filed: Aug. 2, 1993

[51] Int. Cl.[5] ..... C10G 71/00

[52] U.S. Cl. ..... 208/18; 208/33; 208/49; 208/78; 208/87; 208/108; 208/DIG. 1

[58] Field of Search ..... 208/49, 87, 327, DIG. 1, 208/18, 19, 78, 108, 38, 33

[56] References Cited

U.S. PATENT DOCUMENTS

| | | | |
|---|---|---|---|
| 3,549,514 | 12/1970 | Brown et al. | 208/DIG. 1 |
| 3,617,475 | 11/1971 | Offutt et al. | 208/18 |
| 3,656,911 | 4/1972 | Hobbs | 208/DIG. 1 |
| 3,663,422 | 5/1972 | Dun et al. | 208/87 |
| 3,718,809 | 2/1973 | Woodle | 208/DIG. 1 |
| 3,972,779 | 8/1976 | Harrison | 208/DIG. 1 |
| 4,053,744 | 10/1977 | Woodle | 208/DIG. 1 |
| 4,622,129 | 11/1986 | Bayle et al. | 208/87 |
| 4,764,265 | 8/1988 | Bijwaard et al. | 208/87 |
| 4,866,632 | 9/1989 | Mead et al. | 208/87 |

*Primary Examiner*—Paul Lieberman
*Assistant Examiner*—Lorna M. Douyon
*Attorney, Agent, or Firm*—Oblon, Spivak, McClelland, Maier, & Neustadt

[57] ABSTRACT

A process for feed oil refining for production of lubricating oil, by using an equipment for lubricating oil production including a fulfural refining unit, a hydrotreating unit and a ketone dewaxing unit, all connected in series. In this process, operations associated with the switch of feed oil are conducted by carrying out the first to seventh step groups successively. Each step group is initiated when a given time has passed since the start of the previous step group, or when the value of a particular measurement item has reached a target value, or when the value of a particular measurement item has shown a change. First, in the first step group, the amount of feed oil supplied to each unit, etc. is adjusted and, in the second step group, the feed oil to the furfural refining unit is switched. After this switch of feed oil, the operating conditions of the hydrotreating unit and the ketone dewaxing unit are changed so as to keep pace with the change of feed oil when the feed oils to the units have shown respective viscosity changes.

5 Claims, 3 Drawing Sheets

PROCESS FOR FEED OIL REFINING FOR PRODUCTION OF LUBRICATING OIL

BACKGROUND OF THE INVENTION

1. Field of the Invention

The present invention relates to a process for refining a feed oil of petroleum type to produce a lubricating oil. More particularly, the present invention relates to a process for refining a feed oil to produce a lubricating oil, wherein the switch between feed oils can be conducted in a short time.

2. Description of the Related Art

In refining a feed oil of petroleum type to produce a lubricating oil, an equipment for lubricating oil production is generally used which comprises a furfural refining unit (hereinafter referred to as FRU in some cases), a hydrotreating unit (hereinafter referred to as HTU in some cases) and a ketone dewaxing unit (hereinafter referred to as KDU in some cases). FRU has at least an extraction column, a heater fixed to the extraction column and a rotating disc contactor provided in the extraction column, and is for refining a feed oil using a furfural type solvent. HTU has at least a reactor and is for reacting a feed oil supplied from FRU, with hydrogen in the presence of a catalyst. KDU has at least a plurality of filters and is for adding a ketone type solvent (e.g. mixture of methyl ethyl ketone or methyl isobutyl ketone or acetone and benzene or toluene) to a feed oil supplied from HTU, at least two times (primary addition and secondary addition) to cool the feed oil and then subjecting the cooled feed oil to filtration to remove the precipitate (mainly wax) present in the cooled feed oil. These units are connected in the order of FRU, HTU and KDU, and the product oil of one unit is used as a feed oil for the next unit. It is generally preferable that no intermediate storage tank be provided between two adjacent units.

A process for refining a feed oil to produce a lubricating oil by using such an equipment for lubricating oil production is described. First, in FRU, non-paraffinic components (e.g. resinous component) are removed from a feed oil by the use of a furfural type solvent, and the components not dissolved in the solvent are sent to a next unit (HTU) as a product oil having an improved viscosity index. The furfural type solvent is removed in a solvent recovery system and circulated for reuse. Then, in HTU, the product oil of FRU is reacted with hydrogen on a catalyst under the conditions of high temperature and high pressure to remove the impurities (e.g. sulfur compounds) present in the product oil. The resulting oil is treated in a stripper of HTU to remove the gas components (e.g. hydrogen). The refined oil supplied from HTU is sent to KDU and is mixed with a ketone type solvent consisting of, for example, methyl ethyl ketone and benzene or toluene. The mixture is cooled under given conditions and the wax components precipitated as crystals in the mixture are removed by filtration. By the above operation can be obtained a final product (a lubricating oil) having improved low-temperature properties including improved fluidity.

The feed oil used in the above equipment, i.e. the feed oil supplied to FRU is produced from a crude oil via various steps of atmospheric distillation, vacuum distillation, propane deasphalting, etc., is stored in a feed oil tank provided upstream of the equipment for lubricating oil production, and is supplied from the tank. In this case, a plurality of feed oils are prepared depending upon the type of the crude oil used and the desired properties of the lubricating oil to be produced, and a desired lubricating oil is produced by selecting an appropriate feed oil.

In ordinary process plants including the above equipment for lubricating oil production, the control system for operation aims at control of operation in steady state. In the above equipment for lubricating oil production, it is desired to maintain the viscosity, viscosity index and pour point of a lubricating oil to be produced as a final product, at given levels. Hence, the operation of said equipment is controlled so that the operation conditions necessary for treating a feed oil of certain properties to produce a lubricating oil of desired properties are maintained. Therefore, it is conducted, for example, to control, by feed back, the amount of the feed oil to be supplied to the heating furnace so that the outlet temperature of the heating furnace for feed oil is kept constant, or to control, by feed back, the operation conditions of the pump for feeding a solvent into the extraction column so that the flow rate of the solvent in the extraction column is kept constant.

In an equipment for lubricating oil production, such as mentioned above, when the feed oil is switched from one kind to another kind, the equipment is in a non-steady state during the switch period. Herein, the non-steady state refers to a state in which as a result of the switch of the kind of feed oil, i,e, the change of the properties of lubricating oil (final product), the viscosity, etc. of lubricating oil see transitional changes. The lubricating oil obtained during a non-steady state is neither the one corresponding to the feed oil before switch nor the one corresponding to the feed oil after switch, and is an off-specification product. Therefore, for the effective operation of the equipment for lubricating oil production, it is necessary to make the non-steady state as short as possible and reduce the amount of the off-specification product obtained during said state.

In the equipment for lubricating oil production, the control system for operation has conventionally aimed at control of operation in steady state. Hence, the time period of non-steady state operation cannot be made short (the total time required for the switch of feed oil is typically about 10 hours); a large amount of an off-specification lubricating oil is generated; and the procedure associated with the switch of feed oil is complicated, posing a big burden on operators.

SUMMARY OF THE INVENTION

The object of the present invention is to provide a process for feed oil refining for production of lubricating oil, which can conduct the switch of feed oil in a short period of time, which generates a small amount of an off-specification product, and which poses a small burden on operators even in a non-steady state.

The above object of the present invention can be achieved by a process for refining a feed oil to produce a lubricating oil by using an equipment for lubricating oil production comprising (a) a furfural refining unit having at least an extraction column, a heater fixed to the extraction column and a rotating disc contactor provided in the extraction column, and used for refining a feed oil by the use of a furfural type solvent circulated, (b) a hydrotreating unit having at least a reactor and used for reacting a feed oil supplied from the furfural refining unit, with hydrogen in the presence of a catalyst, and (c) a ketone dewaxing unit having at least a plurality of filters and used for adding, to a feed oil supplied from the hydrotreating unit, a ketone type solvent at least two times (primary addition and secondary addition) to cool the feed oil and then subjecting the cooled feed oil to filtration by said filters to remove the precipitate present in the cooled feed oil, wherein the three units (a) to (c) are connected in said order, wherein the product oil of one unit is used as a feed oil of the next unit, and wherein no intermediate tank is provided between two adjacent units, in which process the following seven step groups are conducted in the following order when the feed oil for the furfural refining unit is switched from a first feed oil to a second feed oil during the operation of the above equipment for lubricating oil production:

(I) a first step group conducted before the switch of the first feed oil to the second feed oil, comprising (1) a step of changing the liquid levels of the rundown drum and charge drum belonging to each unit, at given rates, (2) a step of sequentially changing the amount of feed oil supplied to each unit, at a given rate to supply a given amount to each unit, (3) a step of stopping the control of the amount ratio of furfural type solvent to feed oil in the furfural refining unit and (4) a step of stopping the control of the amount ratio of ketone type solvent (each of primary addition and secondary addition) to feed oil in the ketone dewaxing unit, (II) a second step group conducted after the lapse of a given length of time from the initiation of the first step group, comprising (1) a step of switching the feed oil supplied to the furfural refining unit, from the first feed oil to the second feed oil and changing the temperature of the rotating disc contactor part in the furfural refining unit to a temperature matching the second feed oil, at a given rate, (2) a step of changing the temperature of the reactor of the hydrotreating unit to a temperature matching the second feed oil, at a given rate, (3) a step of changing the amount of the bottom rundown oil circulated, of the furfural refining unit to an amount matching the second feed oil and (4) a step of initiating the control for the load and operation conditions of each filter in the ketone dewaxing unit, (III) a third step group conducted when, after the initiation of the second step group, the temperature of the rotating disk contactor part has reached a desired temperature, comprising (1) a step of initiating the control of the amount ratio of furfural type solvent to feed oil in the furfural refining unit in order for the amount ratio to match the second feed oil, (2) a step of initiating the control of the temperature of the heater of the furfural refining unit under the conditions matching the second feed oil, (3) a step of initiating the control of the liquid level of the rundown drum of the furfural refining unit and (4) a step of initiating the checking of the surface of each filter of the ketone dewaxing unit, (IV) a fourth step group conducted when, after the initiation of the third step group, the rundown oil from the furfural refining unit has shown a viscosity change, comprising (1) a step of initiating the control of the amount ratio of ketone type solvent to feed oil (each of primary addition and secondary addition) in the ketone dewaxing unit in order for the amount ratio of ketone type solvent of primary addition to match the second feed oil and (2) a step of initiating the change of the temperature of the reactor of the hydrotreating unit so that the temperature matches the second feed oil, (V) a fifth step group conducted when, after the initiation Of the fourth step group, the rundown oil from the hydrotreating unit has begun to show a viscosity change, comprising (1) a step of changing the temperature of the mixture of feed oil and ketone type solvent in the ketone dewaxing unit to a level matching the second feed oil and (2) a step of initiating the monitoring of the viscosity change of the oil which has passed through the filters of the ketone dewaxing unit, (VI) a sixth step group conducted when, after the initiation of the fifth step group, the viscosity of the rundown oil of the hydrotreating unit has reached a level reflecting the second feed oil, comprising (1) a step of controlling the amount ratio of ketone type solvent to feed oil in the ketone dewaxing unit in order for the amount ratio of ketone type solvent of secondary addition to match the second feed oil, and (VII) a seventh step group conducted when, after the initiation of the sixth step group, the viscosity of the feed oil supplied to the ketone dewaxing unit has reached a level reflecting the second feed oil, comprising (1) a step of initiating the control of the temperature of the feed oil system of the ketone dewaxing unit in order for said temperature to become a level of steady state operation matching the second feed oil and (2) a step of confirming that the viscosity of the filtered oil obtained from the ketone dewaxing unit has reached a level reflecting the second feed oil, followed by completion of a series of operations associated with the feed oil switch from the first feed oil to the second feed oil.

The above and other objects, features and advantages of the present invention will be apparent from the following description referring to the accompanying drawings which will illustrate an example of the preferred embodiment of the present invention.

DESCRIPTION OF THE PREFERRED EMBODIMENT

Figure 1:
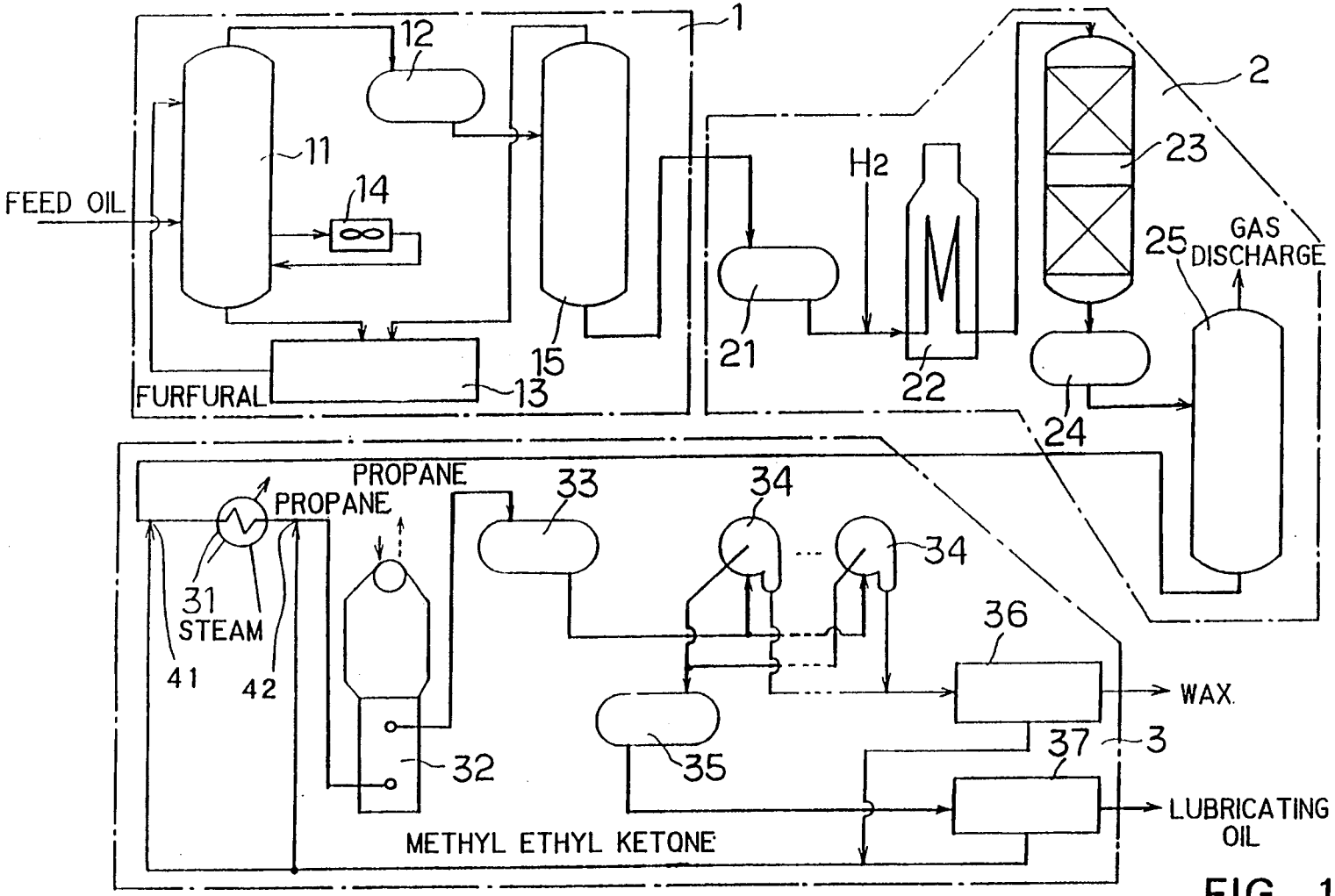
FIG. 1 is a drawing showing the constitution of an equipment for lubricating oil production, used for carrying out an example of the process of the present invention for feed oil refining for production of lubricating oil.

Next, an example of the present process is described with reference to the accompanying drawings. FIG. 1 is a drawing showing the constitution of an equipment for lubricating oil production, used for carrying out an example of the process of the present invention for feed oil refining for production of lubricating oil.

The equipment for lubricating oil production comprises a furfural refining unit (FRU) 1, a hydrotreating unit (HTU) 2 and a ketone dewaxing unit (KDU) 3 all connected in series with FRU 1 provided furthest upstream. The constitutions of FRU 1, HTU 2 and KDU 3 are the same as in conventional equipments for lubricating oil production. That is, FRU 1 has an extraction column 11 for refining a feed oil with a furfural type solvent, a rundown drum 12 for temporarily storing a refined oil from the extraction column 11, a stripper 15 for separating a furfural type solvent from the refined oil, and a furfural recovery section 13 for recovering the furfural type solvent obtained from the solvent outlets of the extraction column 11 and the stripper 15 and circulating the recovered solvent to the extraction column 11. Inside the extraction column 11 is provided a rotating disk contactor (not shown in FIG. 1); to the bottom of the extraction column 11 is attached a column residual heater 14 for heating a column residual. In FRU 1, the feed oil is subjected to removal of non-paraffinic components with the furfural type solvent and the product oil having an improved viscosity index is sent to HTU 2 as a feed oil.

HTU 2 uses the product oil obtained in FRU 1, as a feed oil and comprises a charge drum 21 for storing the feed oil, a heating furnace 22 for heating a mixture of the feed oil and hydrogen, provided downstream of the charge drum 21, a reactor 23 packed with a catalyst, used for reacting the heated mixture of the feed oil and hydrogen, a bottom rundown drum 24 for storing a bottom rundown oil supplied from the reactor 23, provided at the outlet side of the reactor 23, and a stripper 25 for removing gas components from the bottom rundown oil, provided downstream of the bottom rundown drum 24. The hydrogen gas used for the reaction in the reactor 23 is produced in an appropriate hydrogen generator (not shown in FIG. 1) and is added to the feed oil between the charge drum 21 and the heating furnace 22. In HTU 2, the feed oil from FRU 1 is reacted with hydrogen in the reactor 23 under high-temperature and high-pressure conditions in the presence of a catalyst to remove the impurity components (e.g. sulfur compounds), followed by separation of gas components (e.g. hydrogen) in the stripper 25.

KDU 3 uses the product oil obtained in HTU 2, as a feed oil and comprises a heat exchanger 31 for heating the feed oil with steam, a double-tube type chiller 32 for cooling a mixture of the feed oil and a ketone type solvent by the gasification heat of propane, a surge drum 33 for temporarily storing the chilled mixture to be fed to rotary filters 34 (described later), provided downstream of the double-tube type chiller 32, a plurality of rotary filters 34 provided in parallel, a receiver 35 for temporarily storing a filtrate from the rotary filters, provided at the output side of the rotary filters 34, and a ketone recovery section 37 for recovering the ketone type solvent from the filtrate supplied from the receiver 35, to obtain a final product (a lubricating oil). KDU 2 further comprises a wax refining section 36 wherein the solvent-containing wax deposited on the filter cloths of the rotary filters 34 is fed and subjected to solvent removal to obtain a refined wax.

The ketone type solvent is added to the feed oil at two points, i.e. an addition point 41 provided upstream of the inlet of the heat exchanger 31 and an addition point 42 provided downstream of the outlet of the heat exchanger 31 (the former addition is referred to as primary addition and the latter addition is referred to as secondary addition). Methyl ethyl ketone is used as the ketone type solvent, but there may be also used methyl isobutyl ketone, acetone, etc. The ketone type solvent is recovered in the wax refining section 36 and the ketone recovery section 37, and is circulated for reuse. In KDU 3, the refined oil from HTU 2 is mixed with the ketone type solvent; the mixture is cooled in the double-tube type chiller 32; the wax precipitated in the cooled mixture is removed by filtration by the rotary filters 34; then, the filtrate from the rotary filters 34 is subjected to solvent removal to obtain a final product (a lubricating oil).

A plurality of the rotary filters 34 are provided. Since the wax deposited in the feed oil (the refined oil from HTU 2) in the double-tube type chiller 32 differs in its amount, crystalline state, etc. depending upon the kind of the feed oil, an appropriate number of the rotary filters 34 are used depending upon the amount, crystalline state, etc. of the wax deposited. This control is called "control of filter load balance". It is also necessary that the state of wax deposition on the filter cloths of the rotary filters 34 be examined to avoid the clogging of the filter cloths, and this examination is called "control of filter pressure". The control of filter load balance and the control of filter pressure are conducted practically in accordance with the change of the liquid level in the surge drum 33 for storing the chilled mixture to be fed to the rotary filters 34, or in accordance with the change of the back pressure or vacuum of the rotary filters 34.

Next, description is made on how an example of the present process for feed oil refining for production of lubricating oil is conducted using the above equipment for lubricating oil production.

Figure 2:
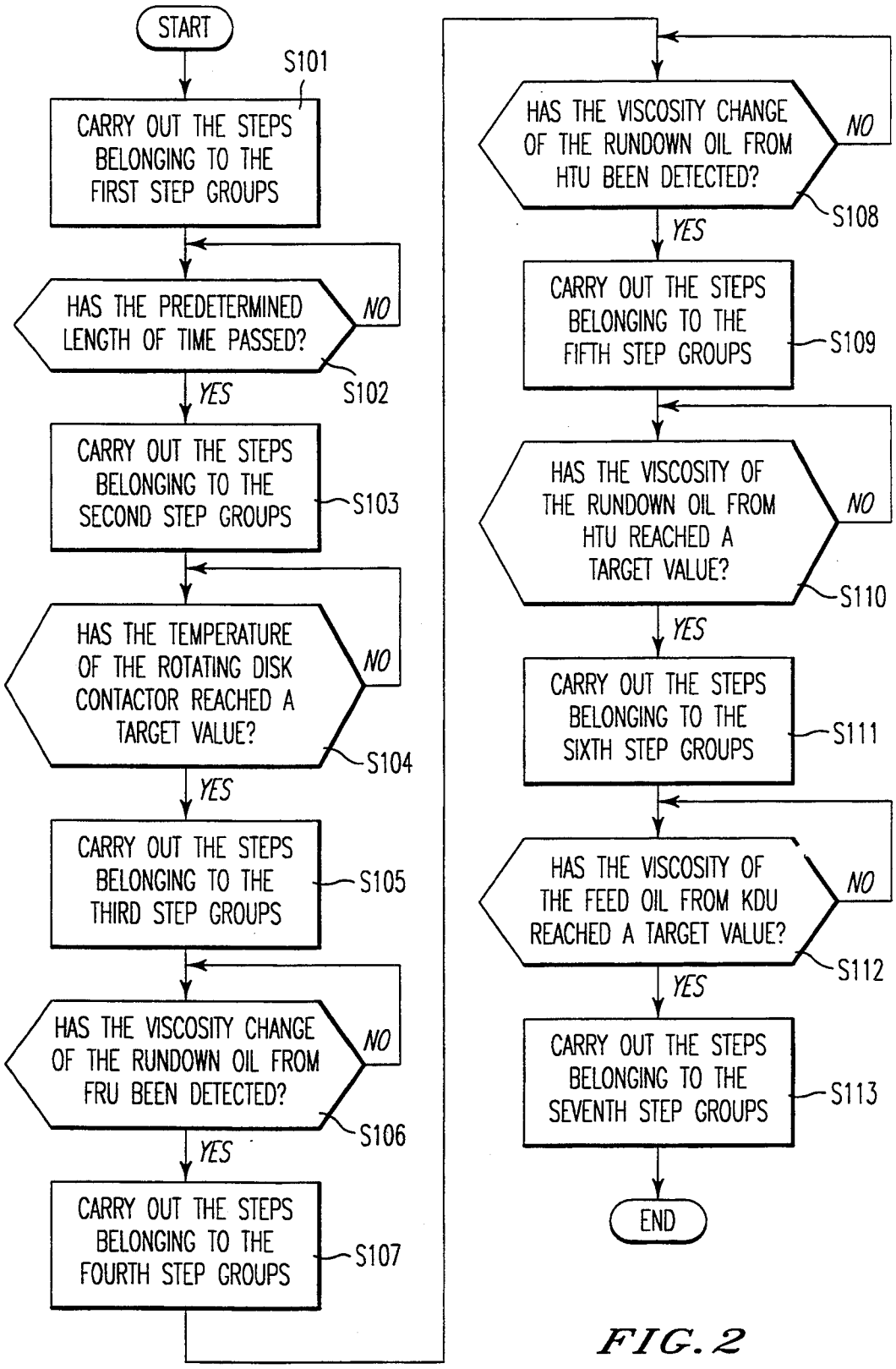
FIG. 2 is a flow chart explaining an example of the process of the present invention for feed oil refining for production of lubricating oil.

In the present example, all the steps required for feed oil refining for production of lubricating oil are classified into 7 step groups and these 7 step groups are conducted orderly, starting from the first step group. FIG. 2 is a flow chart showing the operation flow of feed oil refining for production of lubricating oil. In the present example, computers are used for control of each step.

First, the steps belonging to the first step group are carried out (S101). These steps must be carried out before the feed oil supplied to FRU 1 is switched, and are intended for controlling the amount of feed oil supplied to each unit, etc. When a given length of time has passed from the initiation of the first step group (S102), the steps belonging to the second step group are carried out (S103). In the second step group, the feed oil supplied to FRU 1 is actually switched and the operating conditions, etc. of FRU 1 and HTU 2 are changed. The change of the operating conditions of FRU 1 brings about the change of the temperature of the rotating disk contactor. When it is detected that the rotating disk contactor has reached a predetermined temperature (S104), the steps belonging to the third step group are carried out (S105). In the third step group, a new control is initiated in FRU 1 so as to match the new feed oil.

When the new feed oil passes through FRU 1, the rundown oil from FRU 1 shows a viscosity change. When this viscosity change is detected (S106), the steps belonging to the fourth step group are initiated (S107). In the fourth step group, the operating conditions of HTU 2 are changed and, in KDU 3, control matching the new feed oil is initiated partially. Then, the new feed oil from FRU 1 passes through HTU 2 and the rundown oil from HTU 2 shows a viscosity change. When this viscosity change of the rundown oil from HTU 2 is detected (S108), the steps belonging to the fifth step group are initiated (S109). In the fifth step group, the operating conditions of KDU 3, etc. are changed.

The switch of feed oil inside HTU 2 proceeds and the viscosity of the rundown oil from HTU 2 reaches a certain target value reflecting the new feed oil. When it is detected that the viscosity of the rundown oil from HTU 2 has reached said target value (S110), the steps belonging to the sixth step group are initiated (S111). By initiating the sixth step group, the addition of solvent in KDU 2 is controlled so as to completely match the new feed oil. Then, the viscosity of feed oil in KDU 3 becomes the one approximately matching the new feed oil. When it is detected that the viscosity of feed oil in KDU 3 has reached a target value (S112), the steps belonging to the seventh step group are initiated (S113). In the seventh step group, KDU 3 is operated under the ordinary conditions matching the new feed oil. Thus, a series of operations for feed oil switch are completed.

As described above, in the present example, when a first feed oil is switched to a second feed oil, the amount of feed oil supplied to each unit is adjusted before the switch of feed oil and the operating conditions of each unit are changed so as to correspond to the viscosity change of feed oil supplied to each unit. Therefore, even when a series of operations are under way for the switch of feed oil, each unit is operated under a steady state except for the time when the operating conditions of the unit are being changed. Consequently, the total time required for the switch of feed oil can be decreased; the burden on operators can be reduced; and the amount of off-specification product generated is made smaller. Further, since the change of the operating conditions of each unit is made sequentially, the operation under new control conditions can be initiated in a shorter time, which enables the continuous production of an on-specification lubricating oil even while the switch of feed oil is being made.

In the present example, computers are used for the control of each step, as mentioned above. Since the conditions for initiating each step group are clearly defined, a computer sequence program is set so that each step constituting each step group is initiated when said conditions are met. In that case, each step constituting each step group is initiated with a particular time lag from the initiation time of each step group.

The optimum time lag of each step differs depending upon the dynamic parameters for the operation control of each unit, the volume of reactor, extraction column or each drum, or the combination of said reactor, column and drums. Therefore, the optimum time lag differs depending upon the equipment for lubricating oil production used. Once an optimum time lag is determined and a sequence program is set so as to include it, each step of each step group can be automatically carried out in a predetermined order, whereby a lubricating oil of constant quality (the quality is constant independently of who operates the unit) can be produced. When there is used such a computer sequence program and said time lag can be determined freely, the computer sequence program has high flexibility, for example, when the exchange of apparatus or sections included in the equipment takes place.

Then, description is made on an example in which the process of the present invention for feed oil refining for production of lubrication oil was actually carried out using the above-mentioned equipment for lubricating oil production. The overall operation of this equipment for lubricating oil production is controlled by a computer not shown in FIG. 1. FRU 1 has a capacity of 13,500 bbl/dy; HTU 2 has a capacity of 8,200 bbl/dy; and KDU 3 has 8 rotary filters 34 and a capacity of 8,200 bbl/day. Below is explained a case in which the operation of a feed oil (a SAE 10 grade oil having a viscosity of 24.7 cSt at 40° C.) was switched to the operation of a new feed oil (a SAE 30 grade oil having a viscosity of 32.5 cSt at 40° C).

Before the tank for feed oil supplied to FRU 1 was switched form a SAE 10 oil tank to a SAE 30 oil tank, a computer sequence program was started to conduct the steps belonging to the first step group, i.e. (1) a step of changing the liquid levels of the rundown drum 12 of FRU 1 and the charge drum 21 of HTU 2 at rates of 0.5%/min and 0.7%/min, respectively, to increase each level to 60% and further increasing the liquid level of the surge drum 33 of KDU 3, (2) a step of decreasing the amount of feed oil supplied to FRU 1 from 83 kl/hr to 65 kl/hr at a rate of 0.5 kl/min, (3) a step of stopping the control of the ratio of furfural type solvent to feed oil in FRU 1, and (4) a step of stopping the control of the ratios of primary addition solvent and secondary addition solvent to feed oil in KDU 3. The step (3) of stopping the control of the ratio of solvent to feed oil in FRU 1 is conducted because if the control is continued during the switch period of feed oil, the control gives a greatly fluctuating operation result. The step (4) of stopping the control of the ratios of primary addition solvent and secondary addition solvent to feed oil in KDU 3 is conducted to avoid excessive operational fluctuation, and said ratios are set each at a safer side.

In the first step group, all the steps were not initiated simultaneously, and each step was initiated with a given time lag from the start of the first step group. That is, simultaneously with said start, there were initiated the step of decreasing the amount of feed oil supplied to FRU 1 and the step of stopping the control of the ratio of solvent to feed oil in FRU 1. After 8 minutes from the start of the first step group, there was initiated the step of increasing the liquid level of the rundown drum 12 of FRU 1 and, after 10 minutes from the start, there was stopped the control of the ratio of primary addition solvent to feed oil in KDU 3. After 12 minutes from the start, there was stopped the control of the ratio of secondary addition solvent to feed oil in KDU 3 and there was initiated the increase of the liquid level of the charge drum 21 of HTU 2. After 20 minutes from the start, there was initiated the increase of the liquid level of the surge drum 33 of KDU 3.

By conducting each step of the first step group as above, the intended conditions were met after about 30 minutes from the start of the first step group. Then, the steps belonging to the second step group were initiated. As in the steps of the first step group, each step of the second step group was initiated with a given time lag from the start of the second step group, according to the computer sequence program.

In the second step group, simultaneously with the start of the second step group, there was conducted a step of switching the feed oil tank of FRU 1 from a SAE 10 oil tank to a SAE 30 oil tank. After 5 minutes from the start of the second step group, there was initiated a step of increasing the amount of bottom residual oil circulated in FRU 1 from 160 kl/hr to 200 kl/hr. After 10 minutes from said start, there was initiated a sequence program of increasing the temperature of the rotating disk contactor part of the extraction column 11 of FRU 1 from 100° C. to 120° C. (the column top), from 90° C. to 100° C. (the column center) and from 70° C. to 80° C. (the column bottom) at the same rate of 1.0° C./min. After 20 minutes from the start of the second step group, there was initiated a sequence program of lowering the temperature of the reactor 23 of HTU 2 from 335° C. to 300° C. at a rate of 0.4° C./min.

As mentioned above, 8 rotary filters 34 are provided in KDU 3. When the SAE 10 grade oil was a feed oil, 7 of the 8 rotary filters were operated, and the feed oil slurry containing the wax precipitated therein by cooling, stored in the surge drum 33 was distributed and supplied to the rotary filters 34. With the switch to a SAE 30 grade oil, control of filter load balance was initiated. At that time, in the rotary filters 34, the filter cloth had a pressure of +97 $mmH_2O$ and the suction side had a vacuum of −290 mmHg. In this control of filter load balance, the liquid level of the surge drum 33 is checked when the condition of wax precipitation has begun to change; the number of rotations of a compressor for suction (not shown in FIG. 1) is increased when the power for suction is insufficient; and the number of rotary filters 34 actually used for filtration is increased when the total filtrability of the rotary filters 34 used is insufficient.

After about 30 minutes from the start of the second step group, it was detected from the change of the amount of the rundown oil from FRU 1 that the temperature of the rotating disk contactor part of FRU 1 had reached a predetermined temperature. When said change was detected, a message of "completion of the change of the rotating disk contactor part" was displayed on a control panel (not shown in FIG. 1). The operator who saw the message, started a computer sequence program for the third step group. This computer sequence program may be started without the help of any operator.

After 10 minutes from the start of the third step group, there was initiated a step of increasing the outlet temperature of the column residual heater 14 of the extraction column 11 of FRU 1 from 210° C. to 220° C. at a rate of 0.3° C./min. Simultaneously therewith, there was initiated a step of monitoring and controlling the liquid level of the rundown drum 12 of FRU 1. After 15 minutes from the start of the third step group, there was initiated a step of changing the feed oil/solvent ratio of FRU 1 from 1.3 (for SAE 10 grade oil) to 1.6 (for SAE 30 grade oil) at a rate of 0.5/hr. There was also initiated a step of monitoring the pressure difference between before filtration and after filtration, of the rotary filters 34 of KDU 3 and checking the condition of the surface of each filter cloth. Thereby, when the liquid level of the surge drum 33 of KDU 3 increased, a message for increasing the number of rotations of the rotary filters 34 was issued and said number of rotations was increased; when the total capability of the rotary filters 34 actually used was insufficient, a message for increasing the number of the rotary filters 34 actually used was issued and 8 rotary filters 34 were operated.

After about 60 minutes from the start of the third step group, it was detected that the viscosity change of the product oil of FRU 1 had begun. When this viscosity change was detected, a fourth step group was started and each step belonging to the fourth group was initiated with a given time lag from the start of the fourth step group.

That is, after 5 minutes from the start of the fourth step group, i.e. the detection of the viscosity change of the product oil of FRU 1, there was initiated a step of increasing the temperature of the rundown oil from the extraction column 11 of FRU 1, at the inlet of the stripper 15 from 180° C. to 190° C. at a rate of 0.3° C./min. After 20 minutes from the start of the fourth step group, there was initiated a step of increasing the temperature of the rundown oil from the reactor 23 of HTU 2, at the inlet of the stripper 25 from 170° C. to 190° C. at a rate of 0.3° C./min. After 30 minutes from the start of the fourth step group, there was initiated the change of the ratio of feed oil/primary addition solvent at KDU 3 from 0.6 to 1.8 at a rate of 0.4/hr. Then, the change of the ratio of feed oil/secondary addition solvent at KDU 3 was also initiated.

After about 60 minutes from the start of the fourth step group, the viscosity change of the product oil of HTU 2 supplied from the bottom of the stripper 25 was detected and a fifth step group was initiated. In the fifth step group, there were initiated a step of increasing the temperature of a ketone type solvent-feed oil mixture in KDU 3, to 60° C. and a step of monitoring the viscosity of a filtrate from the rotary filters 34 of KDU 3.

Then, when the viscosity of the product oil from HTU 2 had reached 6.0 cP (a target value for SAE 30 grade oil), a sixth step group was initiated. That is, there was initiated a step of controlling the ratio of secondary addition solvent/feed oil in KDU 3 to a target value for SAE 30 grade oil.

Subsequently, a seventh step group was started when it was confirmed that the viscosity of the product oil from HTU 2 had reached a value corresponding to the SAE 30 grade oil (the new feed oil to FRU 1). That is, after the start of the seventh step group, there was initiated a step of changing the outlet temperature of the double-tube type chiller 32 (a cooling system for feed oil to KDU 3) to −22° C. which corresponded to the SAE 30 grade oil. Thereafter, when it was confirmed that the viscosity of a filtrate from KDU 3 became a value corresponding to the SAE 30 grade oil, the liquid level of each drum was returned to a level of steady state operation. Thus, a series of operations for switching the feed oil from a SAE 10 grade oil to a SAE 30 grade oil was completed and a new steady state operation was initiated.

Figure 3:
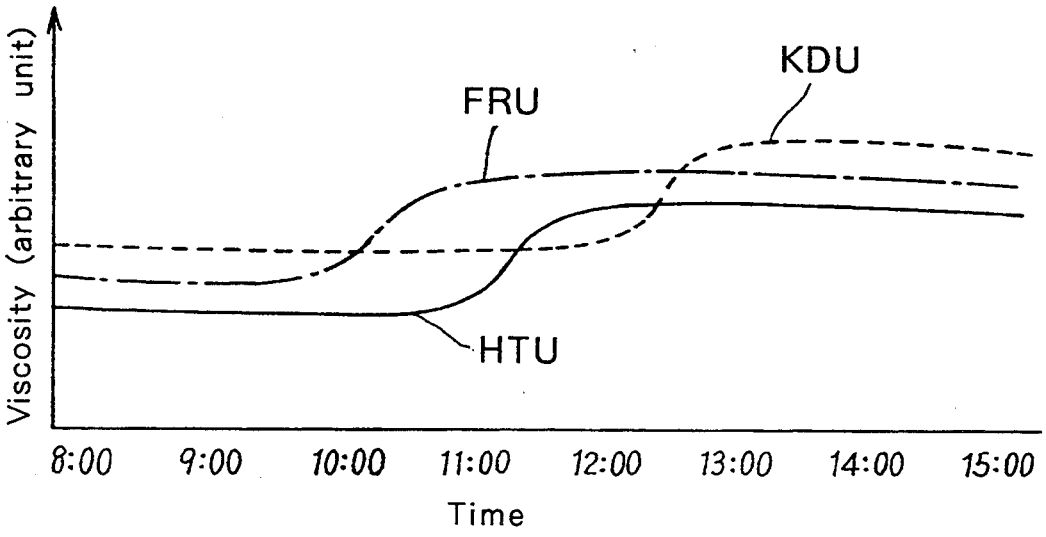
FIG. 3 is a graph showing the changes of the viscosities of the product oils of FRU 1, HTU 2 and KDU 3.

FIG. 3 shows the viscosity changes of the product oils of FRU 1, HTU 2 and KDU 3 when the above-mentioned series of steps for feed oil switch were conducted starting from a time of 8:00. The first step group was started at 8:00 and the second step group was started at 8:30. As a result, the temperature of the rotating disk contactor of FRU 1 reached a target value at 9:00; the viscosity change of the rundown oil from FRU 1 began at 10:00; and the fourth step group was initiated. At this stage, there was yet no viscosity change of the rundown oil from HTU 2. At 11:00 (about 1 hour therefrom), the viscosity change of the rundown oil from HTU 2 began and the fifth step group was started. At this stage, the viscosity of the product oil from FRU 1 reached a level almost completely corresponding to the new feed oil (the SAE 30 grade oil). At 12:00, the viscosity of the rundown oil from HTU 2 reached a level corresponding to the new feed oil and a sixth step group was initiated. Simultaneously therewith, the change of the viscosity of the product oil in KDU 3 began. At 13:00, the viscosity of the feed oil in KDU 3 reached a value corresponding to the new feed oil and a seventh step group was initiated. The first to seventh step groups could be completed in about 5 hours. Thus, in the present example, at first, there was mainly conducted the control of FRU 1 operation associated with the switch of feed oil and, when the switch of feed oil at FRU 1 was almost complete, the controls of HTU 2 operation and KDU 3 operation were conducted with keeping pace with the switch of feed oil.

Meanwhile, when the operations for feed oil switch were conducted according to the conventional process using the same equipment for lubrication oil production, as above, more than 10 hours was necessary to complete all the required operations. That is, in the present example, as compared with the conventional process, the time required for feed oil switch was shorter than half; the operation control kept good pace with the feed oil switch; and the amount of off-specification product was less than half.

In the above example was explained a case of switching a feed oil from a SAE 10 grade oil to a SAE 30 grade oil. The present invention is not restricted thereto and is applicable to various other cases of switching any first feed oil to any second feed oil. Needless to say, at that time, various operational conditions such as temperature, time lag, temperature increase or decrease and the like must be selected so as to match the feed oils used.

It is to be noted that variations and modifications of the process for feed oil refining for production of lubricating oil, disclosed herein will be evident to those skilled in the art. It is intended that all such modifications and variations be included within the scope of the appended claims.

What is claimed is:

1. A process for refining a feed oil to produce a lubricating oil by using equipment for lubricating oil production comprising (a) a furfural refining unit having at least an extraction column, a heater fixed to the extraction column and a rotating disc contactor provided in the extraction column, and used for refining a feed oil by the use of a furfural type solvent circulated, (b) a hydrotreating unit having at least a reactor and used for reacting a feed oil supplied from the furfural refining unit, with hydrogen in the presence of a catalyst, and (c) a ketone dewaxing unit having at least a plurality of filters and used for adding, to a feed oil supplied from the hydrotreating unit, a ketone type solvent at least two times to cool the feed oil and then subjecting the cooled feed oil to filtration by said filters to remove the precipitate present in the cooled feed oil, wherein the three units (a) to (c) are connected in said order, wherein the product oil of one unit is used as a feed oil of the next unit, and wherein no intermediate tank is provided between two adjacent units, in which process the following seven step groups are conducted in the following order when the feed oil for the furfural refining unit is switched from a first feed oil to a second feed oil during the operation of the above equipment for lubricating oil production:

(I) A first step group conducted before the switch of the first feed oil to the second feed oil, comprising (1) a step of changing the liquid levels of the rundown drum and charge drum belonging to each unit, at given rates, (2) a step of sequentially changing the amount of feed oil supplied to each unit, at a given rate to supply a given amount to each unit, (3) a step of stopping the control of the amount ratio of furfural type solvent to feed oil in the furfural refining unit and (4) a step of stopping the control of the amount ratio of ketone types solvent to feed oil in the ketone dewaxing unit, (II) a second step group conducted after the lapse of a given length of time from the initiation of the first step group, comprising (1) a step of switching the feed oil supplied to the furfural refining unit, from the first feed oil to the second feed oil and changing the temperature of the rotating disc contactor part in the furfural refining unit to a temperature matching the second feed oil, at a given rate, (2) a step of changing the temperature of the reactor of the hydrotreating unit to a temperature matching the second feed oil, at a given rate, (3) a step of changing the amount of the bottom rundown oil circulated, of the furfural refining unit to an amount matching the second feed oil and (4) a step of initiating the control for the load and operation conditions of each filter in the ketone dewaxing unit, (III) a third step group conducted when, after the initiation of the second step group, the temperature of the rotating disk contactor part has reached a desired temperature, comprising (1) a step of initiating the control of the amount ratio of furfural type solvent to feed oil in the furfural refining unit in order for the amount ratio to match the second feed oil, (2) a step of initiating the control of the temperature of the heater of the furfural refining unit under the conditions matching the second feed oil, (3) a step of initiating the control of the liquid level of the rundown drum of the furfural refining unit and (4) a step of initiating the checking of the surface of each filter of the ketone dewaxing unit, (IV) a fourth step group conducted when, after the initiation of the third step group, the rundown oil from the furfural refining unit has shown a viscosity change, comprising (1) a step of initiating the control of the amount ratio of ketone type solvent to feed oil in the ketone dewaxing unit in order for the amount ratio of ketone type solvent of primary addition to match the second feed oil and (2) a step of initiating the change of the temperature of the reactor of the hydrotreating unit so that the temperature matches the second feed oil, (V) a fifth step group conducted when, after the initiation of the fourth step group, the rundown oil from the hydrotreating unit has begun to show a viscosity change, comprising (1) a step of changing the temperature of the mixture of feed oil and the ketone type solvent in the ketone dewaxing unit to a level matching the second feed oil and (2) a step of initiating the monitoring of the viscosity change of the oil which has passed through the filters of the ketone dewaxing unit, (VI) a sixth step group conducted when, after the initiation of the fifth step group, the viscosity of the rundown oil of the hydrotreating unit has reached a level reflecting the second feed oil, comprising (1) a step of controlling the amount ratio of ketone type solvent to feed oil in the ketone dewaxing unit in order for the amount ratio of ketone type solvent of secondary addition to match the second feed oil, and (VII) a seventh step group conducted when, after the initiation of the sixth step group, the viscosity of the feed oil supplied to the ketone dewaxing unit has reached a level reflecting the second feed oil, comprising (1) a step of initiating the control of the temperature of the feed oil system of the ketone dewaxing unit in order for said temperature to become a level of steady state operation matching the second feed oil and (2) a step of confirming that the viscosity of the filtered oil obtained from the ketone dewaxing unit has reached a level reflecting the second feed oil, followed by completion of a series of operations associated with the feed oil switch from the first feed oil to the second feed oil.

2. A process according to claim 1, wherein each step constituting each group is initiated with a time lag from the start of the step group.

3. A process according to claim 2, wherein the first to seventh step groups are conducted successively and automatically and automatically in accordance with a sequential stepwise operation.

4. A process according to claim 2, wherein the ketone type solvent is methyl ethyl ketone.

5. The process according to claim 1, wherein each step constituting each step group is initiated with a given time lag of less than thirty minutes from the start of the step group.

* * * * *